US008894922B2

(12) United States Patent
Sorger et al.

(10) Patent No.: US 8,894,922 B2
(45) Date of Patent: Nov. 25, 2014

(54) FIREPROOF CERAMIC IMPACT PAD

(75) Inventors: Robert Sorger, Trofaiach (AT); Wilhelm Janko, Graz (AT); Bernd Trummer, Graz (AT); Gernot Hackl, Trofaiach (AT)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 276 days.

(21) Appl. No.: 13/581,590

(22) PCT Filed: Jul. 1, 2011

(86) PCT No.: PCT/EP2011/061119

§ 371 (c)(1),
(2), (4) Date: Aug. 28, 2012

(87) PCT Pub. No.: WO2012/010399

PCT Pub. Date: Jan. 26, 2012

(65) Prior Publication Data

US 2012/0318831 A1 Dec. 20, 2012

(30) Foreign Application Priority Data

Jul. 19, 2010 (EP) ..... 10007442

(51) Int. Cl.
*B22D 41/00* (2006.01)

(52) U.S. Cl.
CPC ..... *B22D 41/003* (2013.01)
USPC ..... 266/236; 222/594

(58) Field of Classification Search
CPC ..... B22D 41/003
USPC ..... 266/236, 45, 275; 222/594
See application file for complete search history.

(56) References Cited

U.S. PATENT DOCUMENTS

| | | | | |
|---|---|---|---|---|
| 4,776,570 | A | 10/1988 | Vo et al. | |
| 5,358,551 | A | 10/1994 | Saylor | |
| 6,997,361 | B2 * | 2/2006 | Zacharias et al. | 222/594 |
| 7,128,247 | B2 | 10/2006 | Retschnig | |
| 2004/0070123 | A1 | 4/2004 | Morales et al. | |
| 2009/0050285 | A1 * | 2/2009 | Barrett | 164/132 |
| 2013/0221588 | A1 * | 8/2013 | Avila et al. | 266/275 |

FOREIGN PATENT DOCUMENTS

| | | | |
|---|---|---|---|
| DE | 10202537 | C1 | 1/2003 |
| DE | 10235867 | B3 | 4/2004 |
| WO | 02094480 | A1 | 11/2002 |

OTHER PUBLICATIONS

Kim, et al.; "Optimal design of impact pads for tundishes"; Aistech. Iron and Steel Technology Conference Proceedings, 2005; pp. 531-542; Association for Iron and Steel Technology, US.

Craig, et al.; "Design optimization of continuous caster refractory components"; Proceedings of the ASME Design Engineering Technical Conferences and Computers and Information in Engineering Conference—2005 : presented at 2005 ASME Design Engineering Technical Conferences and Computers and Information in Engineering Conference; Sep. 24-28, 2005; pp. 637-646; vol. 2A; Long Beach, California, USA.

Sahai, et al."Melt flow characterisation in Continuous Casting Tundishes"; ISIJ International; 1996; pp. 667-672; vol. 36, No. 6.

* cited by examiner

*Primary Examiner* — Scott Kastler
(74) *Attorney, Agent, or Firm* — Christopher L. Parmelee; Walker & Jocke

(57) ABSTRACT

The invention relates to a fireproof ceramic impact absorber.

12 Claims, 4 Drawing Sheets

FIREPROOF CERAMIC IMPACT PAD

The invention relates to a fireproof (refractory) ceramic impact pad (also called impact pot).

A generic impact pad is for example known from the following publications DE 102 867 B3; DE 102 02 537 C1; U.S. Pat. No. 5,358,551.

In all cases the subject is to minimize turbulences in a metallurgic vessel which is caused when a metal melt impacts (clashes against) a solid base. This is for example the case when metal melt from a ladle clashes with the bottom of a tundish at a ferrostatic al height of several meters.

The impact pad according to U.S. Pat. No. 5,358,551 has a classical pot-shape wherein the free upper end segment of the wall is turned inwardly. After clashing against the base of the impact pad the metal melt initially flows along the base, then upwards along the inside of the wall and finally around the narrowed impact pad opening upwards into the distributing vessel.

At the version according to DE 102 35 867 B3, the impact pad is equipped with a so called diffuser at the upper open end, which means that the cross-section of the impact pad is increasing towards the upper outlet-end to reduce the kinetic energy of the effusing melt.

The suggestion according to DE 102 02 537 C1 includes an impact pad, whose wall is featuring at least one slit, which extends continuously from the edge (the upper free end of the wall) to the bottom, whereby the slit width at the widest spot is less than 10% of the width in direction of the width of the ground plan.

Usually impact pads have a circular or rectangular base. Correspondingly the wall is infinite or consists of four wall segments. The base can also be differently, for example oval shaped or egg shaped. The invention is mainly related to impact pads, which are symmetrical (mirror inverted) regarding a vertical plane.

Details in the following are related to a common function of the impact pad (functional position), wherein the base of the impact pad lies on or in the base of a metallurgic vessel and wherein the wall of the impact pad is mainly extending perpendicular to the base and thereby mainly perpendicular to the base of the metallurgic vessel in an upward direction.

The impact pad according to DE 102 02 537 C1 leads to the fact that metal melt entering the impact pad drains at least partially through the wall-sided slit. Because of the relatively small slit width, the metal melt flowing through the slit can feature a significant flow speed. Thereby, further flow turbulences are caused.

The essay "Melt flow characterisation in Continuous Casting Tundishes" (ISIJ International, Vol. 36 (1996), No. 6, p. 667-672) defines a so called plug flow, wherein all fluid elements have the same residence time in the tundish and a so called dead volume. The dead volume characterises the fluid part, whose residence time is more than double of the average residence time of the melt in the tundish.

Hereinafter these characterisations are phenomenologically transferred to the flow (stream) of a metal melt in a tundish, into which an impact pad corresponding to the invention is integrated.

The task of the invention is to provide an impact pad, which allows the following optimisations:

- an aimed guidance of the metal melt in the impact pad and tundish
- minimisation of flow turbulences in the tundish
- less wear of the impact pad

- high amount of fluid with plug flow in the tundish
- little dead volume in the tundish
- cheap manufacturing costs of the impact pad In order to make an impact pad, which fulfils as many as possible of these criteria, extensive tests and investigations have been conducted, particularly regarding improved flow properties of the metal melt. In doing so, the following has been investigated:

- the flow properties of the melt after impacting (clashing with) the base of the impact pad,
- the flow path of the melt in the impact pad
- the flow properties of the melt when exiting the impact pad
- the flow properties of the melt after exiting the impact pad in the melt bath of the corresponding metallurgic vessel.

It has been assessed that the known impact pad geometry is in need of improvement, especially regarding the flow properties of the melt when leaving the impact pad and when entering the melt bath of the corresponding metallurgic vessel.

It is beneficial to lead a part of the melt in a volume stream of a relatively high cross-sectional area out of the impact pad at its side (laterally). The direction of flow is mainly horizontal or in an angle of <70°, especially <450 to the horizontal. It has also been proved to be beneficial to design the impact pad in such a way, that the volume stream which is leaving through the side wall is getting wider at the top (towards the free upper segment of the impact pad).

As a result, this led to an impact pad geometry wherein the impact pad wall features at least one opening (for example a slit) with a specific cross-sectional profile. The width of this opening widens from the base of the impact pad towards the upper free end segment of the wall (in perimeter/circumferential direction), that means that at a slit-shaped opening, the distance between the flanks limiting the slit increases.

By this means a relatively wide volume stream (flow) with a relatively low flow speed is laterally led out of the impact pad in the upper segment of the impact pad. Analogously the volume stream which escapes close to the base of the impact pad is narrower and features a higher flow speed. Because of this flow profile, turbulences are reduced when entering the molten metal bath in the metallurgical vessel.

This leads to a lesser erosion of the fireproof material of the impact pad, especially in the area of the flanks (boundaries) of the opening. Correspondingly, fewer pollutants (impurities) get into the metal melt in the tundish.

A further part of the flow leaves the impact pad—as known—upwardly

The specific geometry of the opening and the thereby caused specific flow of the melt, through the sidewall opening in the impact pad, also leads to the wanted reduction of dead volume in the tundish and to a higher percentage of plug flow as the following chart shows:

| | Dead volume | Plug flow |
|---|---|---|
| Impact pad with closed wall according to U.S. Pat. No. 5,358,551 | 28% | 24% |
| Impact pad with small, linear slit according to DE 10202537C1 | 28% | 26% |
| Impact pad according to FIG. 4 | 24% | 30% |

The formation of openings with relatively big cross-sections in the wall-area of the impact pad leads to the fact that less fireproof (refractory) material has to be used. This reduces the manufacturing costs.

In its most general embodiment, the invention relates to a fireproof ceramic impact pad with the following characteristics in its functional position:

- a bottom with a lower base-area and an upper impact-area
- a wall, consisting of several segments, which extends from the bottom up to a free end-segment, wherein the wall with its inside and the impact area border a space, which is open at its end opposite the bottom,
- at least one segment of the wall features at least one opening, which runs from the inside (inner face) of the wall continuously to the outside (outer face) of the wall and which is bordered by opposite flanks,
- the opening features the following cross-sectional profile:
- regarding the perimeter direction of the wall the opening has its largest width adjacent to the free end segment
- regarding the perimeter direction of the wall the opening has its smallest width adjacent to the bottom,
- the largest width of the opening is more than 5% of the total perimeter of the wall of the impact pad,
- in a longitudinal direction, from the upper free end segment of the wall vertically downwards toward the bottom, the opening extends in a profile with more than 70% of its cross-section in the upper half, adjacent to the free end segment of the wall.

In the side view, there is regularly a geometry of the opening, wherein the distance between the flanks of the opening is much wider at the top than at the bottom. Possible cross-sectional profiles are presented and explained in the following description of a drawing.

The opening can continue upwardly such that the free end of the wall is interrupted. The opening can also be arranged as a discrete opening in the wall being surrounded all along its periphery by wall segments. To achieve an optimised flow and flow distribution, cross-sectional profiles are preferred which are symmetrical to a plane running perpendicular to the inside of the wall, or in other words: The mirror plane runs radial with an impact pad of circular layout (base), whose wall features a cylindrical peripheral area.

The flow profile is optimised when the opening features curved flanks, especially between the parts of the largest and smallest width. In a side view a profile of the opening similar to a cone or nozzle is visible.

Further embodiments provide that the opening in the area between the biggest and smallest width features convex or concave curved flanks in relation to the central longitudinal axis. This means, that the width of the opening continuously decreases between the segments of biggest width and smallest width.

The opening ends, according to one embodiment, with a distance to the bottom. Therefore, inside the impact pad, a bottom sump is formed, in which the metal melt is located regularly during the casting process.

The opening should extend over at least 20% of the height of the wall. According to this embodiment there would be no lateral wall opening along 80% of the height of the impact pad. The melt would only escape in the upper area of the end-segment of the wall laterally through the at least one opening of the impact pad.

This flow profile is optimised, when the opening extends over a larger part of the height of the wall, for example more than 40%, more than 50%, more than 60% or more than 70%. The area of the impact pad wall without a lateral opening can be at least 20% of the height of the wall, calculated from the bottom (base). This results in a maximum extension of the opening over 80% of the height of the wall, calculated from its upper end.

In order to specifically lead the melt from the interior of the impact pad to the opening, one embodiment of the invention suggests to feature the inside of the wall, between the impact area of the bottom and the opening, with a slope of <90° to the horizontal. A kind of "accumulation slope" is formed along which the melt, after it has hit the impact area, is led not only laterally, but also laterally upwardly and directed towards the corresponding opening. This embodiment is also displayed in more detail in the following description of a drawing.

The last mentioned embodiment requires that the opening ends with a distance to the base of the impact pad.

The opening can also run continuously from the free end to the bottom. This generally corresponds to the embodiment according to DE 102 02 537 C1. The crucial difference to the known impact pad is, that the slit (the opening) in the wall of the impact pad is considerably bigger according to the invention and especially characterised by the fact that the cross section of the opening is increasing in size in a direction toward the upper rim (the free edge).

The largest width of the opening is, according to the invention, larger than 5% of the total perimeter (circumference) of the wall of the impact pad. This means that for an impact pad with a quadratic/square bottom and correspondingly four equal wall segments, the largest width of the opening is larger than 20% of the width of the corresponding wall segment. This value is, according to the invention, also valid for impact pads with a rectangular ground plan provided that the value of the opening width is relating to the wall segment in which the opening is located.

For impact pads with a circular base and correspondingly a cylindrical wall area the following is essential: the largest width of the opening is more than 5% of the total perimeter of the wall of the impact pad. If one divides the wall into four equal segments, the value for the largest width of the opening, relating to each segment, is larger than 20%.

This is analogously valid for embodiments of impact pads with an oval shaped ground plan.

For other geometrical shapes the following extra condition is valid, beside the condition that the largest width of the opening should be larger than 5% of the total perimeter of the wall: the largest width of the opening has to be larger than 20% of a quarter of the total perimeter of the wall. The largest width is expediently limited to 25% of the total perimeter of the impact pad wall.

The smallest width of the opening (at the end of the opening/the slit, which is next to the impact pad bottom) is for example <4%, <2.5%, <1.5%, <1.0% of the total perimeter of the wall and can also, for example in connection with a V-shape of the slit, tend towards zero. The maximum value is expediently 5%.

Concrete values are for example:

1. for the largest width: >100 mm, >150 mm, >200 mm, >250 mm, >300 mm
2. for the smallest width: <100 mm, <75 mm, <50 mm, <25 mm, <10 mm According to one embodiment of the invention, corresponding flanks of the opening are arranged with increasing distance between the inside of the wall and a corresponding outside of the wall.

Thereby, a kind of "diffuser" is formed with the result, that the cross sectional area of the opening between the inside and the outside of the wall increases in size (expanding fan-shaped). Thus a balloon-type volume stream/flow is led into the metal bath of the metallurgic vessel, which leads to a decrease of turbulences in the metallurgic vessel.

Within this embodiment the flanks can be curved towards the outer surrounding, which supports this effect.

Further characteristics of the invention result from the characteristics of the sub-claims and the further application documents. The named characteristics can be important for the realisation of the invention by their own or in any combination with each other. As far as it isn't excluded explicitly the characteristics of individual embodiments can be combined with each other as far as it is technically possible.

BRIEF DESCRIPTION OF THE DRAWINGS

The figures show, each in a schematic representation.

DETAILED DESCRIPTION

Figure 1:
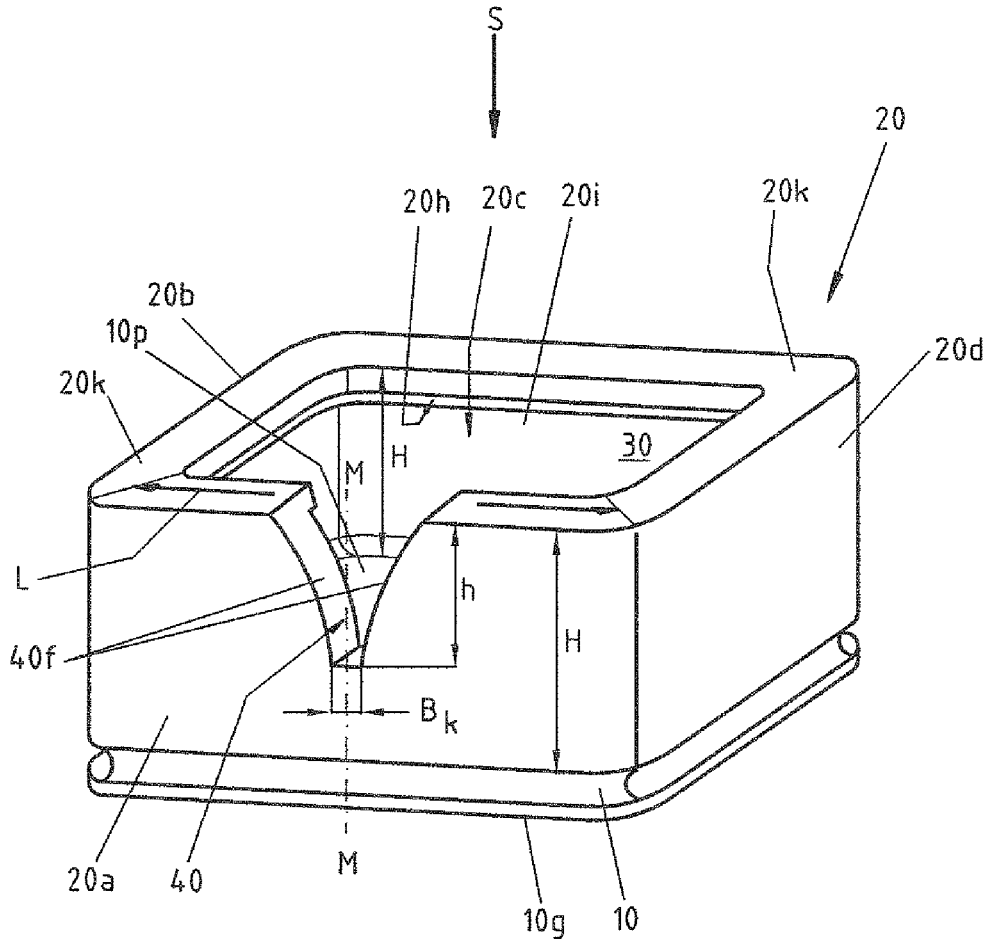
FIG. 1 shows a perspective view of an impact pad.

The impact pad according to FIG. 1 is structured as followed: it possesses a rectangular bottom 10 with a lower base area 10*g* and an upper impact surface 10*p*. A wall 20 extends from the rim area of the bottom 10, which correspondingly contains four wall segments 20*a*, 20*b*, 20*c* and 20*d*.

The wall 20 with its inside 20*i* and the impact surface 10*p* border a space 30, which is open towards the top, thus opposite the bottom.

The free end 20*k* of the wall segments 20*a* to 20*d* is turned inwardly, so that a corresponding undercut 20*h* is achieved between the vertical areas of the wall segments 20*a* to 20*d* and the free end 20*k* (end segment).

The wall segment 20*a* features an opening 40 which extends from the free end 20*k* to over half the height H of the wall segment 20*a*. The vertical height h of the opening 40 equals to approximately 0.6H. The opening has its largest width Bg at the top end and its smallest width Bk at the lower end. Intermediately, the flanks 40*f* of the opening 40 are curved inversely with respect to the central longitudinal axes M-M of the opening 40, so that a continuously decreasing cross sectional geometry from the upper end to the lower end is formed. The flanks 40*f* run in a 90° angle to the inside 20*i* of the wall 20.

The largest width Bg of the opening 40 is approximately 35% of the middle (mean) length L of the corresponding wall segment 20*a* and therefore approximately 9% of the total perimeter of the wall 20. The metal melt (schematically labelled by arrow S) which is flowing into the impact pad initially clashes onto the impact surface 10*p* and then distributes along the impact surface 10*p*, before it runs upwards along the inside 20*i* of the wall 20. While afterwards the melt is redirected and led upwards out of the impact pad (the same is valid for the melt, which flows along the wall 20*a* beside the opening 40) in the area of the wall segments 20*b*, 20*c* and 20*d*, namely along the area of the free end 20*k* featuring the undercut, a significant part of the volume of the melt leaves the space 30 through the opening 40. The flow speed is reduced analogously with an increase of the width of the opening 40. The direction of flow is mainly horizontal at the narrow end of the opening 40 and at the top, wide end it is skewed upwardly. Thus an advantageous supply of the melt from the impact pad into the corresponding metallurgic vessel or rather into the melt located in the vessel is created.

Figure 2:
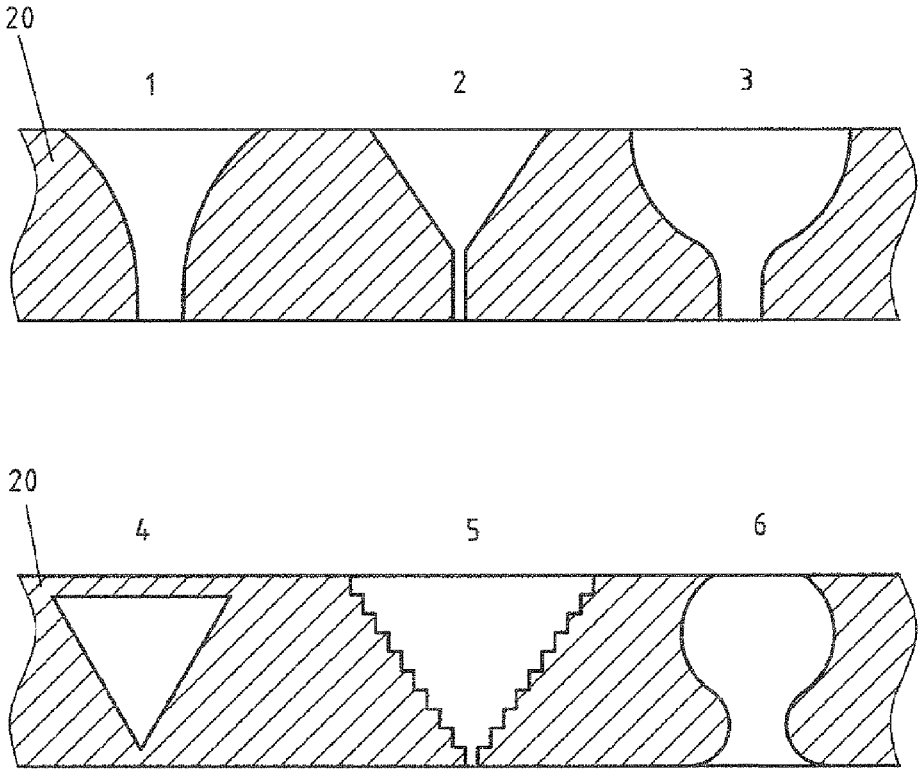
FIG. 2 shows possible cross-sectional shapes of the opening in the wall of the impact pad.

FIG. 2 displays some possible cross sectional shapes of the wall opening 40. Number 1 is similar to the example in FIG. 1, however the opening extends all the way down to the bottom. The alternative no. 2 features approximated the cross sectional profile of a cone. At no. 3 the flanks of the opening are bowl-shaped. The opening according to no. 4 is completely within the wall 20 and corresponds incidentally also to the upper part according to no. 2. At no. 5 the flanks are not curved, but step-like. The cross-sectional geometry according to no. 6 is similar to the one of a chalice.

Figure 3:
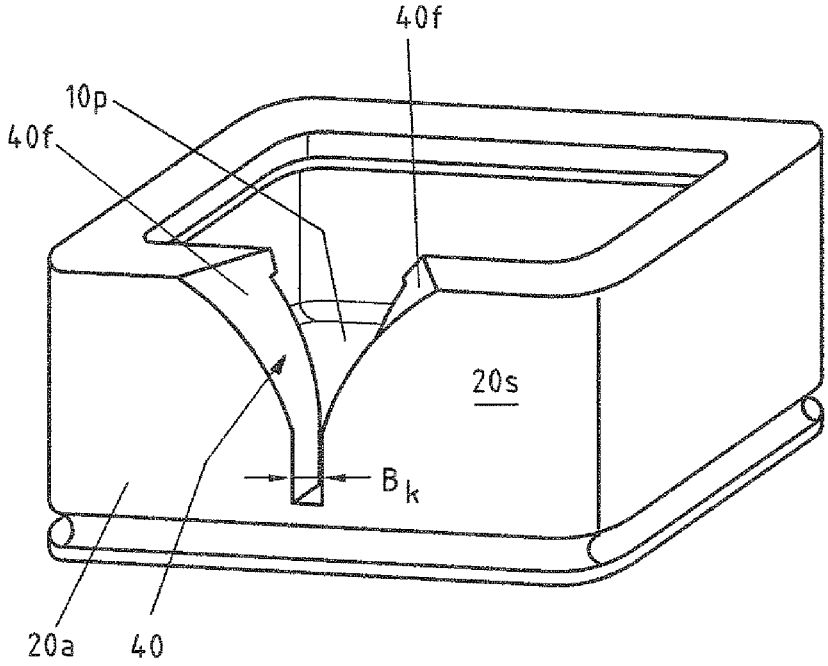
FIG. 3 shows a perspective view of a further embodiment of an impact pad.

The embodiment according to FIG. 3 differs from the one in FIG. 1 through the fact, that the opening 40 extends to the bottom 10, which means it runs down to the impact surface 10*p* and that it is slit-like in its lower segment with a constant width Bk. A further difference to the embodiment of FIG. 1 is that the flanks 40*f* are opening (diverging) towards the outside 20*s* of the wall 20*a*, whereby an extra diffuser-effect during effusion of the metal melt is reached.

Figure 4:
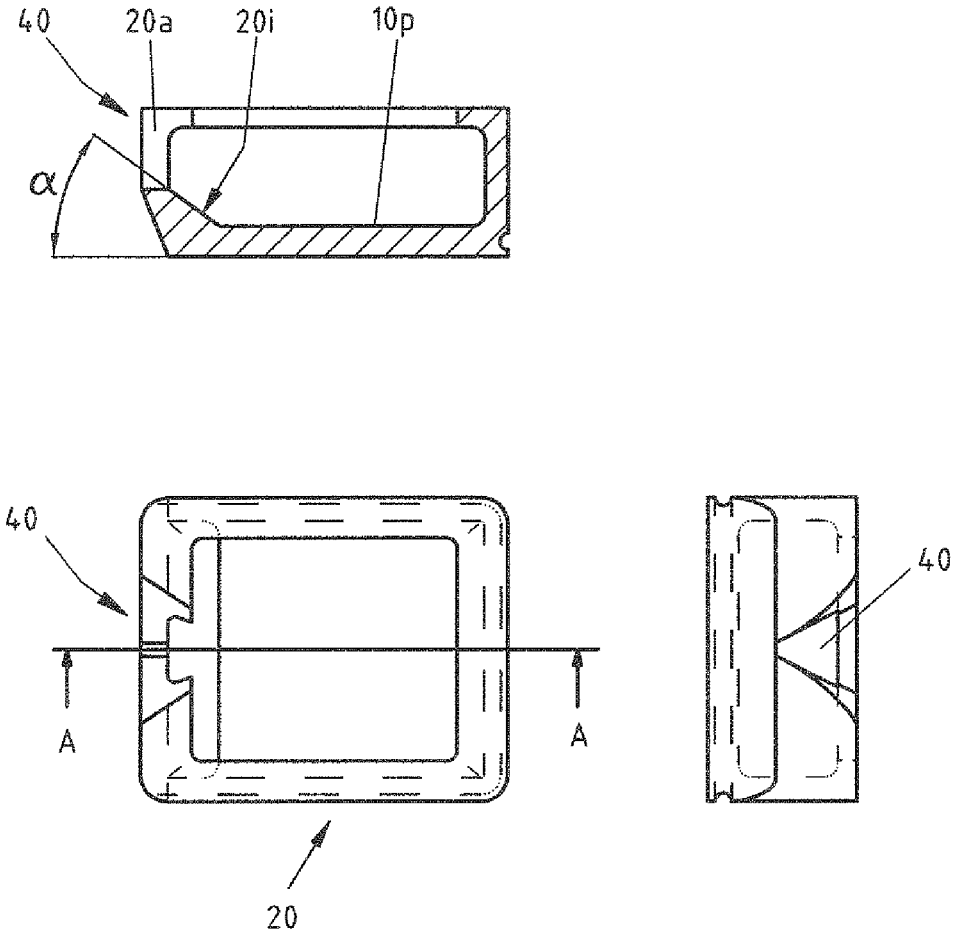
FIG. 4 shows a top-view, a longitudinal section and a lateral view of a third embodiment of the impact pad.

The embodiment according to FIG. 4 provides a major difference to the other embodiments displayed insofar as the inside 20*i* of the wall 20*a* rises in an angle α of circa 45° (to the horizontal) from the impact surface 10*p* towards the opening 40 whereby a kind of starting slope towards the opening 40 is formed for the metal melt. The opening 40 ends, as the lateral view shows, similarly to the embodiment according to FIG. 1 with a distance to the impact surface 10*p* and features, similarly to FIG. 3, a diffuser area.

For all embodiment types the following is valid:

The impact pad is made of a fireproof ceramic material, for example based on magnesia, magnesia-chromite, bauxite, Al2O3 or mixtures thereof.

Impact pads featuring an upper free end segment of the wall (wall-parts) widened to the inside are advantageous, so that the melt which is effusing upwardly out of the impact pad is redirected to the inside beforehand.

The base area of the impact pad is more or less arbitrary, but impact pads with a circular base and a cylindrical wall and impact pads with a rectangular, especially quadratic base and correspondingly four wall segments with a right angle to each other are definitely preferred in relation to the manufacturing process and the flow properties.

In each impact pad at least one opening of the described type is arranged in the wall. Especially at impact pads with a rectangular cross-section, opposite wall segments can feature analogous openings.

Each opening is significantly narrower at in its segment next to the bottom than at its segment which is next to the upper rim (the upper edge) of the impact pad. Thus in the lateral view there is regularly a cross-sectional profile, where the width of the opening decreases from top to bottom.

Only by this means the required volume flow can be guided away laterally and the required distribution of flow speed can be reached.

It is also essential that at least 70% of the total cross-section of each opening are in a segment which defines the upper half of the wall, regarded in a vertical direction.

In all cases the result for the effusing metal melt is that the melt stream in the area of the opening is widening from bottom to top and that it features a lower flow speed at the top than at the bottom.

The flow direction can be adjusted by a corresponding shape of the flanks of the opening, especially in terms of leading the stream such that the cross-section of the volume stream is increasing with increasing distance to the impact pad.

The invention claimed is:

1. Fireproof ceramic impact pad with the following features in its functional position:

1.1 a bottom (10) with a lower base area (10*g*) and an upper impact surface (10*p*), 1.2 a wall consisting of multiple segments (20*a-d*), which extends from the bottom (10) up to a free end (20*k*), wherein the wall (20) with its inside (20*i*) and the impact area (10*p*) together border a space (30), which is open at its end opposite the bottom (10), 1.3 at least one segment (20*a*) of the wall (20) features at least one opening (40), which runs from the inside (20*i*) of the wall continuously to the outside (20*s*) of the wall (20) and which is bordered by opposite flanks (40*f*), 1.4 the opening (40) features the following cross-sectional profile:

1.4.1 regarding the perimeter direction of the wall (20) the opening (40) has its largest width (Bg) adjacent to the free end (20*k*), 1.4.2 regarding the perimeter direction of the wall (20) the opening (40) has its smallest width (Bk) adjacent an end of the opening that is closest to the bottom (10), 1.4.3 the largest width (Bg) of the opening (40) is more than 5% of the total perimeter of the wall (20) of the impact pad, 1.4.4 in a longitudinal direction, from the upper free end (20*k*) of the wall (20) vertically downwards toward the bottom, the opening (40) extends in a profile with more than 70% of its cross-section in an upper half of the opening, adjacent to the free end (20*k*) of the wall (20).

2. Impact pad according to claim 1, wherein the opening (40) features curved flanks (40*f*) in an area between the largest width (Bg) and the smallest width (Bk).

3. Impact pad according to claim 1, wherein the opening (40) features curved flanks in relation to a central longitudinal axis of the opening (40) in the area between the largest width (Bg) and the smallest width (Bk).

4. Impact pad according to claim 1, wherein the opening (40) ends with a distance to the bottom (10).

5. Impact pad according to claim 4, wherein the inside (20*i*) of the wall (20), between the impact area (10*p*) of the bottom (10) and the opening (40), extends with a slope of <90 degrees to the horizontal.

6. Impact pad according to claim 4, wherein the opening (40) extends over at least 20% and at most 90% of the height (H) of the wall (20).

7. Impact pad according to claim 1, wherein the opening (40) extends from the free end (20*k*) down to the bottom (10).

8. Impact pad according to claim 1, wherein corresponding flanks (40*f*) of the opening (40) are arranged with increasing distance between the inside (20*i*) of the wall (20) and a corresponding outside (20*s*) of the wall (40).

9. Impact pad according to claim 8, wherein the corresponding flanks (40*f*) of the opening (40) are curved in a direction towards the surrounding between an inside (20*i*) of the wall (20) and the corresponding outside (20*s*) of the wall (20).

10. Impact pad according to claim 1 with four segments (20 *a-d*) of the wall (20), wherein neighbouring segments (20*a*-20*b*, 20*b*-20*c*, 20*c*-20*d*, 20*d*-20*a*) are substantially arranged at a right angle to each other.

11. Impact pad according to claim 1, wherein the opening (40) is arranged mirror-inverted to a plane, which sticks out vertically from the inside (20*i*) of the wall (20).

12. Impact pad according to claim 1, the upper free end (20*k*) of which is redirected or widened towards the inside, towards space (30).

* * * * *